United States Patent [19]

Gibney

[11] Patent Number: 4,779,388

[45] Date of Patent: Oct. 25, 1988

[54] SHELTER

[76] Inventor: Raymond T. Gibney, 427 Old Chicopee Rd., Kitchener, Ontario, Canada, N2G 3W6

[21] Appl. No.: 36,668

[22] Filed: Apr. 8, 1987

[30] Foreign Application Priority Data

Apr. 9, 1986 [CA] Canada ..... 506387

[51] Int. Cl.[4] ..... E04B 1/346

[52] U.S. Cl. ..... 52/71; 52/236.1

[58] Field of Search ..... 52/81, 71, 79.4, 236.1

[56] References Cited

U.S. PATENT DOCUMENTS

| | | | |
|---|---|---|---|
| 2,754,550 | 1/1956 | Johnson et al. | 52/71 X |
| 4,064,662 | 12/1977 | O'Toole | 52/81 X |
| 4,181,095 | 1/1980 | Sylogye | 52/71 X |
| 4,480,414 | 11/1984 | Tschudy et al. | 52/236.1 X |

*Primary Examiner*—Carl D. Friedman
*Assistant Examiner*—Creighton Smith
*Attorney, Agent, or Firm*—Daryl W. Schnurr

[57] ABSTRACT

A make-shift shelter has a hexagonal shape and can be errected and dismantled quickly and efficiently without tools. The various pieces of material that make up the shelter are flat and are easily stored. In one embodiment of the invention, the shelter is constructed from three sheets of plywood measuring approximately four feet by eight feet. Two tapered sides and a rectangular-shaped piece for the roof are formed from each sheet. The sides and roof pieces contain suitable openings so that a polypropylene rope can be threaded through said openings to hold the various pieces together to form the shelter.

11 Claims, 4 Drawing Sheets

SHELTER

BACKGROUND OF THE INVENTION

1. Field of the Invention

This invention relates to an make-shift shelter that can be erected or dismantled without tools.

2. Description of the Prior Art

It is known to have relatively small sheds that are designed to house tools and small equipment or designed as a playhouse for children. However, previous sheds can be relatively expensive to manufacture; they cannot be erected or dismantled without tools; they cannot be easily moved and are not designed to be dismantled and stored; they are not designed to utilize materials efficiently; or, they have an unattractive appearance.

SUMMARY OF THE INVENTION

It is an object of the present invention to provide a shelter that is relatively inexpensive, can easily be assembled or dismantled without tools, has a pleasant appearance and can easily be moved or stored.

A make-shift shelter that can be erected or dismantled without tools has six sides and a roof. Each side is formed of one piece of material and has top, bottom and side edges, said side edges being adjacent to one another and being tapered from bottom to top so that a space enclosed by the shelter decreases in size from bottom to top. The roof is formed of a plurality of rectangular-shaped pieces. A plurality of suitable small openings is located in the pieces forming the roof and the pieces forming the sides. A rope is provided that can be threaded methodically through said small openings to hold the pieces together to form said shelter, one of said sides having a relatively large opening formed therein to serve as an entrance and exit.

DESCRIPTION OF A PREFERRED EMBODIMENT

Figure 1:
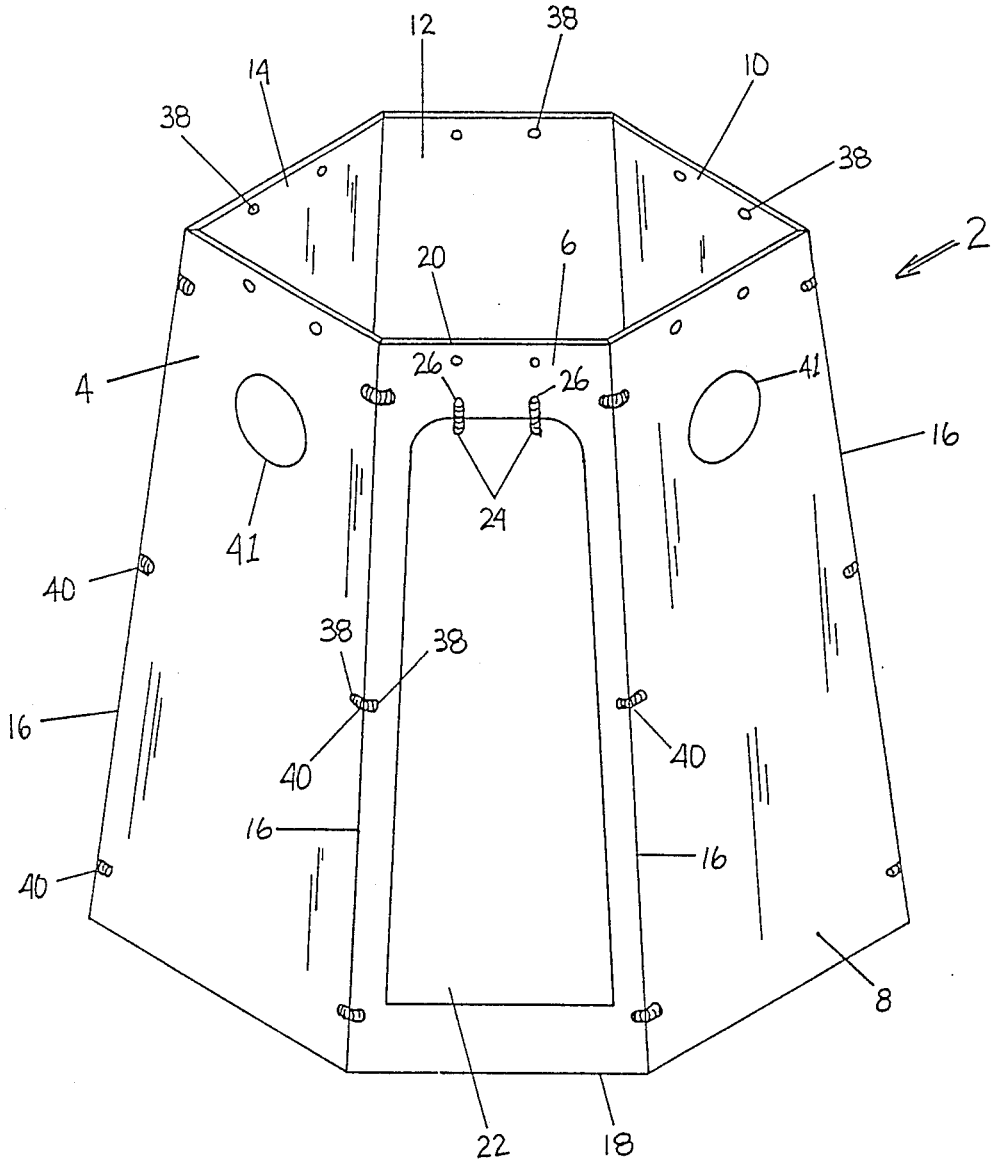
FIG. 1 is a perspective view of a shelter constructed in accordance with the present invention, with a roof removed.

Referring to the drawings in greater detail, in FIG. 1 there is shown a make-shift shelter 2 with a roof removed. The shelter 2 has six sides 4, 6, 8, 10, 12, 14. Each side side has edges 16 that are tapered from a bottom edge 18 to a top edge 20 so that a space enclosed by the shelter 2 decreases in size from bottom to top. The side 6 has a relatively large opening (not shown) formed therein to serve as an entrance and exit. A door 22 is formed from a piece of material removed from said large opening for the entrance and exit and has two small openings 24 along an upper edge thereof corresponding to two small openings 26 in the side 6 above the entrance and exit.

Figure 2:
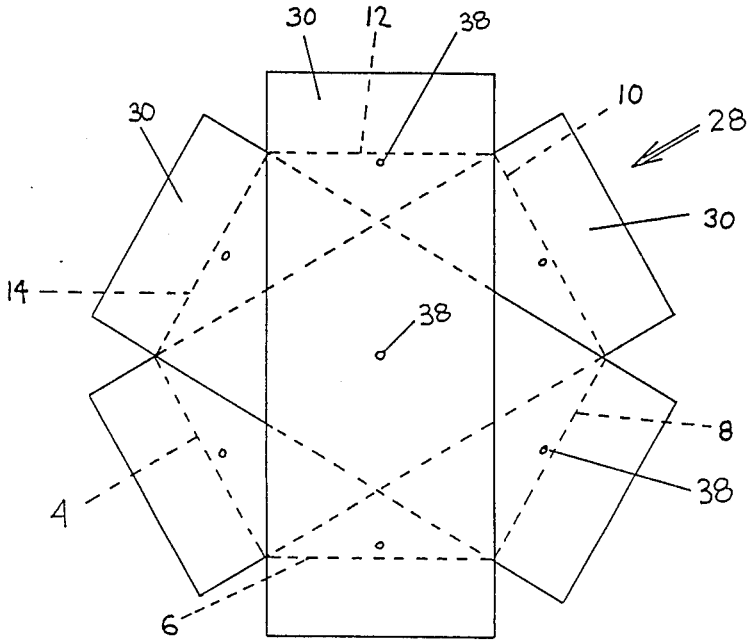
FIG. 2 is a top view of the shelter of FIG. 1 showing the arrangement of pieces on the roof.

In FIG. 2, there is shown a roof 28 being formed of a plurality of rectangular shaped pieces 30. The roof 28 has three pieces 30 that partially overlap with one another and extend across a top 20 of said shelter 2, one piece extending between each pair of opposing sides. In other words, one piece 30 extends across the top 20 between to the sides 4, 10. A second piece 30 extends across the top 20 between the sides 6, 12 and a third piece 30 extends across the top 20 between the sides 8, 14.

Figure 3:
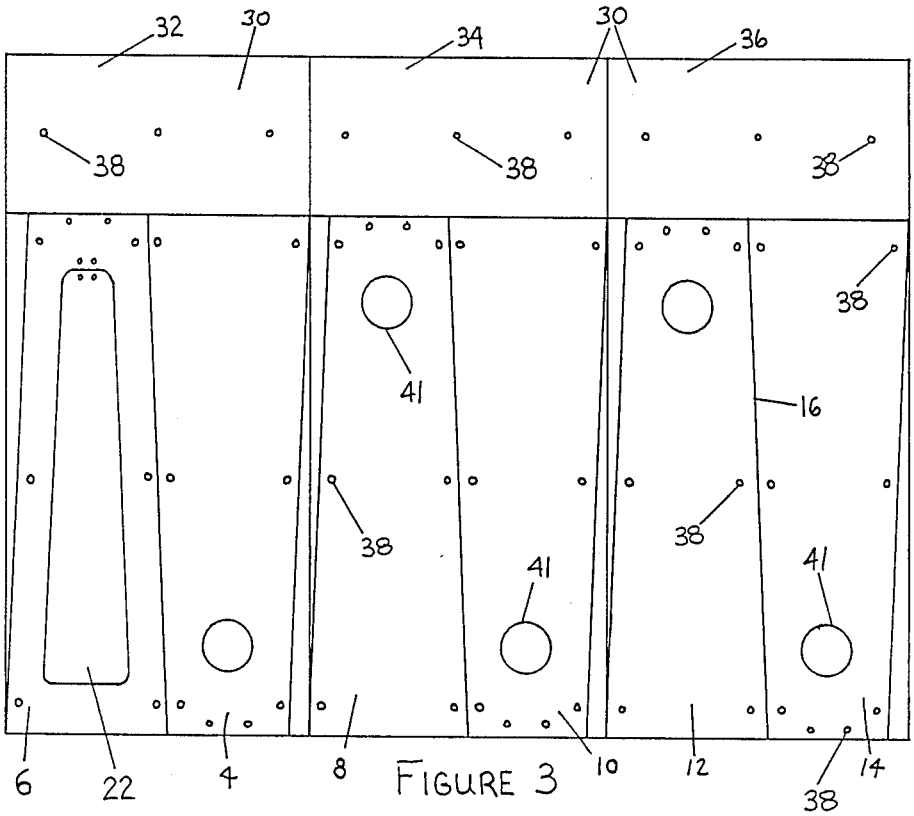
FIG. 3 is a schematic side view of three sheets of material showing the manner in which the sides and roof pieces of the shelter of FIGS. 1 and 2 can be cut.

In FIG. 3, there is shown three sheets 32, 34, 36 of plywood having dimensions of approximately four feet by eight feet. From the sheet 30, the sides 4, 6 and one roof piece 30 can be cut. From the piece 34, the sides 8, 10 and the second roof piece 30 can be cut. From the sheet 36, the remaining two sides 12, 14 and the third roof piece 30 can be cut. It can be seen that there is very little waste material when the pieces 4, 6, 8, 10, 12, 14, 30 are cut from the sheets in this manner. Preferably, the plywood has a thickness of three-eighths of an inch but other thicknesses could be used as well.

All pieces contain suitable small openings 38 therein so that a rope 40 can be threaded methodically through the openings 38 to hold the pieces together to form said shelter 2. Preferably, the roof pieces 30 of the shelter 2 each have an opening 38 in the centre. Preferably, the pieces that form the sides 4, 6, 10, 12, 14 have equally spaced circular openings 38 along the tapered edges 16 of each side, there being three openings for each tapered edge. It has been found that the shelter 2 requires approximately one hundred feet of rope. Preferably, the rope is polypropylene rope. The rope can be threaded through adjacent openings along each of the edges 16, being threaded up one edge and down the adjacent edge until the shelter is formed into the shape shown in FIG. 1. Then, the rope can be threaded through the central openings 38 in the roof pieces 30 and through additional openings 38 near the ends of the roof pieces 30. Alternatively, the rope can be cut into four appropriate lengths and one length can be threaded horizontally around the bottom openings 38; a second length of rope can be threaded through the openings 38 at a middle level in such a manner that the door is not blocked off; a third length of rope can be threaded horizontally through the top opening 38; the fourth length of rope can be threaded through the central openings 38 in the roof pieces 30 and through the additional openings 38 near the ends of the roof pieces 30 and the openings 38 centrally located at the top 20 of each side 4, 6, 8, 10, 12, 14.

One or more of the sides 4, 8 has a medium size opening 41, which serves as a window. The shelter 2 has a floor area of approximately eleven square feet.

Figure 4:
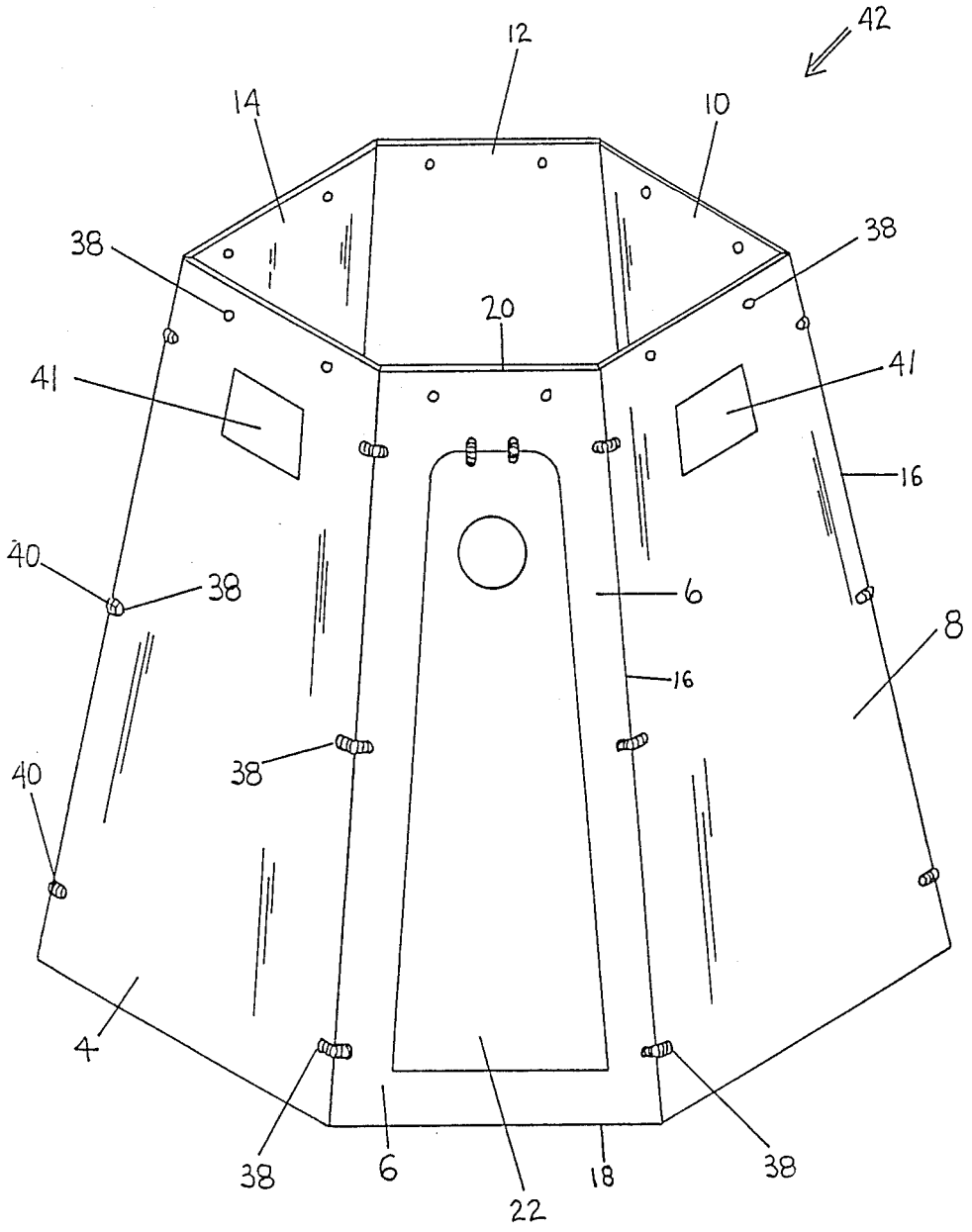
FIG. 4 is a perspective view of a larger shelter than that shown in FIG. 1 with a roof removed.

In FIG. 4, there is shown a shelter 42 that is larger than the shelter 2. Since the components of the shelter 42 are virtually identical to the components of the shelter 2, except for their size, the same reference numerals that were used for the shelter 2 of FIGS. 1 and 2 have been used on the shelter 42 of FIGS. 4 and 5. From FIGS. 5 and 6, it can be seen that the shelter 42 is formed from six sheets 34, 46 of material. Only two sheets of material are shown in FIG. 6. Each sheet measures approximately four feet by eight feet and one side 4 and one roof piece 30 is formed from each sheet.

The roof piece 30 has a rectangular shape and measures approximately two feet by four feet.

Figure 5:
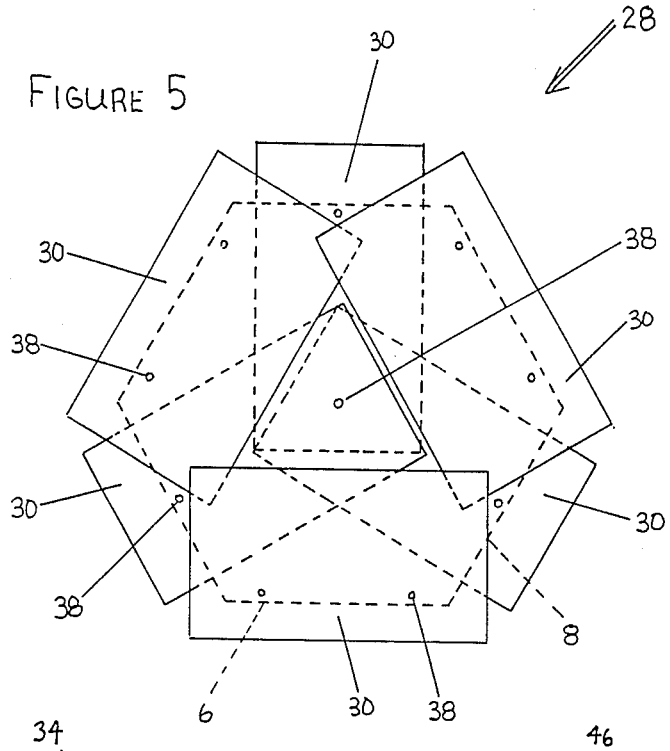
FIG. 5 is a top view of the shelter of FIG. 4 showing the arrangement of pieces on the roof.
Figure 6:
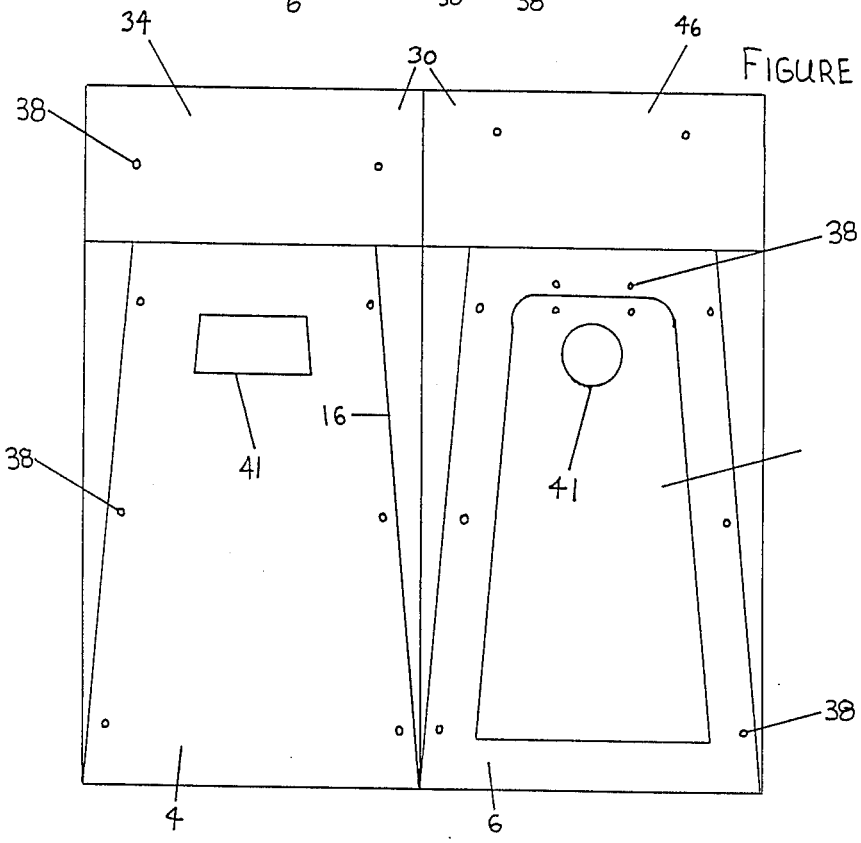
FIG. 6 is a side view of two sheets of material showing how the sides and roof pieces are cut for the shelter of FIG. 4.

From FIG. 5, it can be seen that the roof 28 is made up of six pieces 30, the first three of the pieces 30 having a centrally located opening 38 at one end thereof. An end opposite to said centrally located opening is a free end. The centrally located openings 38 are aligned with one another and with a vertical centre axis of said shelter 42. The first three pieces are partially overlapping and said free ends are substantially equidistant from one another as shown. The first three pieces are supported by a top of said sides and leave three gaps in said roof. The remaining three pieces 30 are supported by said first three pieces 30 and a top of said sides, each of said remaining three pieces covering one of the gaps. All of the pieces 30 contain suitable openings 38 for receiving the rope 40. The sides 4, 6, 8, 10, 12, 14 of the shelter 42 have equally spaced openings 38 located along each of the tapered said edges 16 to receive the rope 40. As with the shelter 2, one or more of the sides 4, 8 have a medium size opening 41 therein that serves as a window. As with the shelter 2, the shelter 42 has a door 22 that substantially closes the large opening that is the entrance and exit. The rope 40 for the shelter 42 has a length of approximately 200 feet. The rope 40 can be threaded through the openings 38 in a manner similar to that described for the shelter 2. The shelter 42 has a floor area of approximately thirty-three square feet. The door 22 of both shelters 2, 42 is a swingable door that can be pushed outward so that it swings on the rope 40 when one wishes to enter or exit from the shelter.

While the two embodiments of the invention described herein are formed from either three or six sheets of plywood measuring approximately four feet by eight feet, shelters of different sizes could be formed from sheets of different sizes and different materials. It is important that the amount of waste material be kept to an absolute minimum. The various openings for receiving the rope can be located in virtually any reasonable location and these openings are preferably formed by drilling. As an alternative, the roof of one or both of the shelters 2, 42 can be formed from an extra sheet of material. For the shelter 2, the roof can be formed of one piece of material. For the shelter 42, the roof can be formed from one, two or three pieces of material. As a further alternative, the degree of taper on the sides of the shelter 42 can be increased, thereby decreasing the area of the roof and the size of materials required to cover the roof. The rope is preferably divided into four separate lengths but could be one continuous length or more than four separate lengths with each rope being threaded through a minimum of three openings. Alternatively, the rope or ropes could be replaced by wires. There are numerous additional variations that can be made to the shelter, all within the scope of the attached claims.

As an example of the use of the shelter, it could be erected at the end of a laneway adjacent to the road to serve as a shelter for children as they await the school bus. Similarly, a shelter could be used as a playhouse for children or as a garden house to store tools and equipment or as a privy. It is a relatively simple matter to dismantle the shelter and as all of the pieces are flat, they can be stored in a relatively small space. Some children will obtain enjoyment by erecting and immediately dismantling the shelter. The rope is quite safe and the shelter can be erected and dismantled without the use of tools.

What I claim as my invention is:

1. A make-shift shelter that can be erected or dismantled without tools, said shelter comprising six sides topped by a roof, each side being formed of one piece of material and having top, bottom and side edges, said side edges being adjacent to one another and being tapered from bottom to top so that a space enclosed by the shelfter decreases in size from bottom to top, said roof being formed of a plurality of rectangular-shaped pieces, a plurality of suitable small openings being located in the pieces forming the roof and the pieces forming the sides, with a rope that can be threaded methodically through said small openings to hold the pieces together to form said shelter, one of said sides having a relatively large opening formed therein to serve as an entrance and exit.

2. A shelter as claimed in claim 1 wherein the shelter is formed from three sheets of material of suitable thickness, two sides and one piece for the roof being formed from each sheet, said roof being formed from three partially overlapping pieces that extend across a top of said shelter, one piece extending between each pair of opposing sides.

3. A shelter as claimed in claim 2 wherein each sheet of material has dimensions of approximately four feet by eight feet and each piece for the roof has dimensions of approximately two feet by four feet.

4. A shelter as claimed in any one of claims 2 or 3 wherein each piece for the roof has a circular opening in the centre for receiving the rope and each piece for the sides has equally spaced circular openings along the tapered edge of each side, there being three openings for each tapered edge for receiving the rope and approximately one hundred feet of rope.

5. A shelter as claimed in any one of claims 2 or 3 wherein one or more of the sides has a medium size opening therein to serve as a window.

6. A shelter as claimed in claim 2 wherein the shelter is formed from six sheets of material, a rectangular piece for the roof measuring approximately two feet by four feet, and the tapered piece for each side being formed from one sheet of material.

7. A shelter as claimed in claim 6 wherein each sheet measures approximately four feet by eight feet.

8. A shelter as claimed in claim 7 wherein the roof is made up of six pieces each having a size of approximately two feet by four feet, the first three of the pieces having a centrally located opening at one end thereof, an end opposite to said centrally located opening being a free end, said centrally located openings being aligned with one another and with a vertical centre axis of said shelter, with said first three pieces partially overlapping said free ends and being substantially equidistant from one another, said first three pieces being supported by a top of said sides and leaving three gaps in said roof, the remaining three pieces being supported by said first three pieces and the top of said sides, each of said remaining three pieces covering one of the gaps, all of said pieces containing suitable openings thereof for receiving the rope.

9. A shelter as claimed in claim 6 wherein the sides have equally spaced openings located along each of the tapered edges to receive the rope.

10. A shelter as claimed in claim 9 wherein one or more of the sides has a medium size opening therein to serve as a window.

11. A shelter as claimed in any one of claims 2 or 6 wherein there are two small openings in that side of the shelter where the entrance and exit are located, said two small openings being located above the entrance and exit, and the entrance and exit is covered by a swingable door, said door being formed from a piece of material that was removed from the large opening for the entrance and exit, said door having two small openings along an upper edge thereof corresponding to said two small openings in the side of the shelter above the entrance and exit, said rope extending through said small openings to hold said door on said side so that it can substantially close said large opening, when desired.

* * * * *